US007984522B1

(12) United States Patent
Pfleger

(10) Patent No.: US 7,984,522 B1
(45) Date of Patent: Jul. 26, 2011

(54) REMOVABLE BED RUFFLE ASSEMBLY AND ASSOCIATED METHOD

(76) Inventor: Karen Pfleger, Palm Desert, CA (US)

( * ) Notice: Subject to any disclaimer, the term of this patent is extended or adjusted under 35 U.S.C. 154(b) by 0 days.

(21) Appl. No.: 12/897,875

(22) Filed: Oct. 5, 2010

Related U.S. Application Data

(60) Provisional application No. 60/310,932, filed on Mar. 5, 2010.

(51) Int. Cl.
*A47G 9/02* (2006.01)

(52) U.S. Cl. ..... 5/493; 5/486; 5/499

(58) Field of Classification Search ..... 5/493, 482, 5/486, 499, 923, 925
See application file for complete search history.

(56) References Cited

U.S. PATENT DOCUMENTS

| | | | | |
|---|---|---|---|---|
| 5,086,531 | A * | 2/1992 | Carlos | 5/493 |
| 5,335,383 | A | 8/1994 | Schwind | |
| 5,733,397 | A | 3/1998 | McDaniel | |
| 2005/0086740 | A1 | 4/2005 | Babjak | |

FOREIGN PATENT DOCUMENTS

| | | |
|---|---|---|
| WO | WO/2006/089135 | 8/2006 |

OTHER PUBLICATIONS http://www.shopzilla.com/detachable-gathered-bedskirt/1122144133/compare.

* cited by examiner

*Primary Examiner* — Fredrick Conley

(57) ABSTRACT

An interchangeable bed ruffle assembly may include a bed platform capable of intercalating between the top mattress and the box-spring base of a bed. The bed platform has first fasteners attached to a top surface and juxtaposed along a perimeter and across an entire width of the bed platform respectively. An adjustable bed ruffle may be removably attached to the bed platform and be capable of being seated about an outer perimeter of the top mattress and the box-spring base. The bed ruffle preferably has a second fasteners attached to its inner surface. The plurality of second fasteners may be removably connected to select ones of the first fasteners respectively such that the bed ruffle hangs downwardly from the perimeter of the bed platform. In this way, the bed ruffle is freely disconnected from the bed platform while the bed platform remains at a stationary position.

10 Claims, 5 Drawing Sheets

REMOVABLE BED RUFFLE ASSEMBLY AND ASSOCIATED METHOD

CROSS REFERENCE TO RELATED APPLICATIONS

This application claims the benefit of U.S. Provisional Application No. 61/310,932, filed Mar. 5, 2010, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to bed ruffles and, more particularly, to a removable bed ruffle for providing users with an easy and convenient means of changing their bed ruffles without having to lift the mattress.

2. Prior Art

A bed is a piece of furniture used as a place to sleep. Beds may consist of a mattress placed on top of a box spring inner-sprung base. The box spring is a large mattress-sized box containing wood and springs that provide additional support and suspension for the mattress. The box spring will typically lie on a bed frame (which lifts the mattress/mattress-box spring off the ground) or on slats (usually made of 1"×4" wood). A "headboard", "side rails", and "footboard" or "front rail" will complete the bed. "Headboard only" beds often incorporate a dust ruffle, bed ruffle, or valance platform to hide the bed frame. The bed ruffle may be a decorative piece used to cover the box spring and legs of the bed and fits between the mattress and box spring and hangs to the floor.

The bed ruffle is usually placed below the mattress and its ruffles hanging down may be easily dirtied due to it being exposed to the external elements such as vacuum cleaners, mops and the like. The portion of the bed ruffle under the mattress is usually clean. For traditional bed ruffles, the complete bed ruffle complete with the ruffles have to be removed from the bed for cleaning periodically. This is done by progressively lifting the mattress on one side, pulling the bed ruffle off that side and going on to another side until the complete bed ruffle is pulled off the bed. For a female such as a house wife or the elderly, this may prove difficult and tedious due to the weight of the mattress and usually two persons are required to do the job.

Accordingly, a need remains for an apparatus in order to overcome the above-noted shortcomings. The present invention satisfies such a need by providing a removable bed ruffle that is convenient and easy to use, lightweight yet durable in design, versatile in its applications, and provides for changing bed ruffles without having to lift the mattress.

BRIEF SUMMARY OF THE INVENTION

In view of the foregoing background, it is therefore an object of the present invention to provide an assembly for assisting a user to quickly customize a bedding set without having to remove a top mattress from an associated box-spring base. These and other objects, features, and advantages of the invention are provided by a removable bed ruffle.

The interchangeable bed ruffle assembly may include a bed platform capable of intercalating between the top mattress and the box-spring base of a bed respectively. The bed platform preferably has a plurality of first fasteners attached to a top surface and juxtaposed along a perimeter and across an entire width of the bed platform respectively. A bed ruffle may be removably attached to the bed platform and be capable of being seated about an outer perimeter of the top mattress and the box-spring base. The bed ruffle preferably has a plurality of second fasteners attached to its inner surface. The plurality of second fasteners may be removably connected to selected ones of the first fasteners respectively such that the bed ruffle hangs downwardly from the perimeter of the bed platform. In this way, the bed ruffle is freely disconnected from the bed platform while the bed platform remains at a stationary position. Such an arrangement provides the unexpected and unpredictable advantage of easily removing and attaching the bed ruffle from and to the bed platform without having to remove the top mattress from the box-spring base of the bed.

The first fasteners may include primary male and primary female fasteners configured along a plurality of primary male and primary female linear paths respectively, defined along the top surface of the bed platform. A first group of each of the primary male and primary female fasteners may be oriented parallel to an x-axis and a second group of the primary male and primary female fasteners may be oriented parallel to a y-axis. One skilled in the art understands that bed platforms are made in different sizes such as king, queen, full and twin bed sizes for example. Such an arrangement provides the unexpected and unpredictable advantage of enabling the apparatus to be configured according to the size of the bed in a one-size-fits-all construction.

The second fasteners may include auxiliary female fasteners configured along an auxiliary female linear path defined along a top edge of the bed ruffle. The auxiliary female fasteners may be oriented parallel to the x-axis and located subjacent to a majority of the primary male and primary female fasteners respectively when the bed ruffle is attached to the bed platform. Such an arrangement provides the unexpected and unpredictable advantage of attaching the auxiliary female fasteners of the bed ruffle to the male fastener of the bed platform easily by a user. The bed ruffle may in addition be removed for washing with ease and be replaced with a matching bedding set without having to remove the bed platform below the top mattress.

A first linear array of the first group of primary female fasteners may be registered parallel to an entire longitudinal edge of the bed platform and detachably connected to a first linear array of the first group of primary male fasteners such that the entire longitudinal edge of the bed platform folds over an entire longitudinal length of the top surface and thereby uniformly reduces a lateral width of the bed platform. Such an arrangement provides the unexpected and unpredictable advantage of reducing the width of the bed platform with the linear arrays positioned to correspond with the various bed sizes as mentioned hereinabove.

A second array of the first group of primary female fasteners may be located along a corner of the bed platform and thereby detachably connected to a second array of the first group of primary male fasteners such that the corner of the bed platform folds over a portion of the top surface and thereby creating a linear edge diagonally extending from the longitudinal edge of the bed platform to a latitudinal edge of the bed platform. Such an arrangement provides the unexpected and unpredictable advantage of folding the corner edges of the bed platform in order to clear the bed posts of postal beds.

The bed platform may include first and second halves each preferably having a medial longitudinal edge and a third fastener linearly extending along the medial edges of the first and second halves respectively. In this way, the first and second halves are removably coupled to each other via the third fastener when the medial edges are arranged in an overlapping pattern. The third fastener may be of the hook and loop type commonly used for removably attaching flexible and soft fabric platform materials. Such an arrangement provides the unexpected and unpredictable advantage of reducing the width of the bed platform so that the first and second halves may be used separately for smaller beds thus saving expenses for the user from not having to purchase a multiple of these smaller bed platforms.

The invention may include a method of utilizing an interchangeable bed ruffle assembly for assisting a user to quickly customize a bedding set without having to remove a top mattress from an associated box-spring base. Such a method may include the chronological steps of: providing a bed platform preferably having a plurality of first fasteners attached to a top surface thereof, the first fasteners may be juxtaposed along a perimeter of the bed platform and across an entire width of the bed platform; providing a bed ruffle preferably having a plurality of second fasteners attached to an inner surface thereof; intercalating the bed platform between the top mattress and the box-spring base respectively; removably attaching the bed ruffle to the bed platform by removably connecting the second fasteners to selected ones of the first fasteners respectively; downwardly hanging the bed ruffle from the perimeter of the bed platform such that the bed platform becomes seated about an outer perimeter of the top mattress and the box-spring base respectively; and customizing the bed ruffle assembly by freely disconnecting the bed ruffle from the bed platform while the bed platform remains at a stationary position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
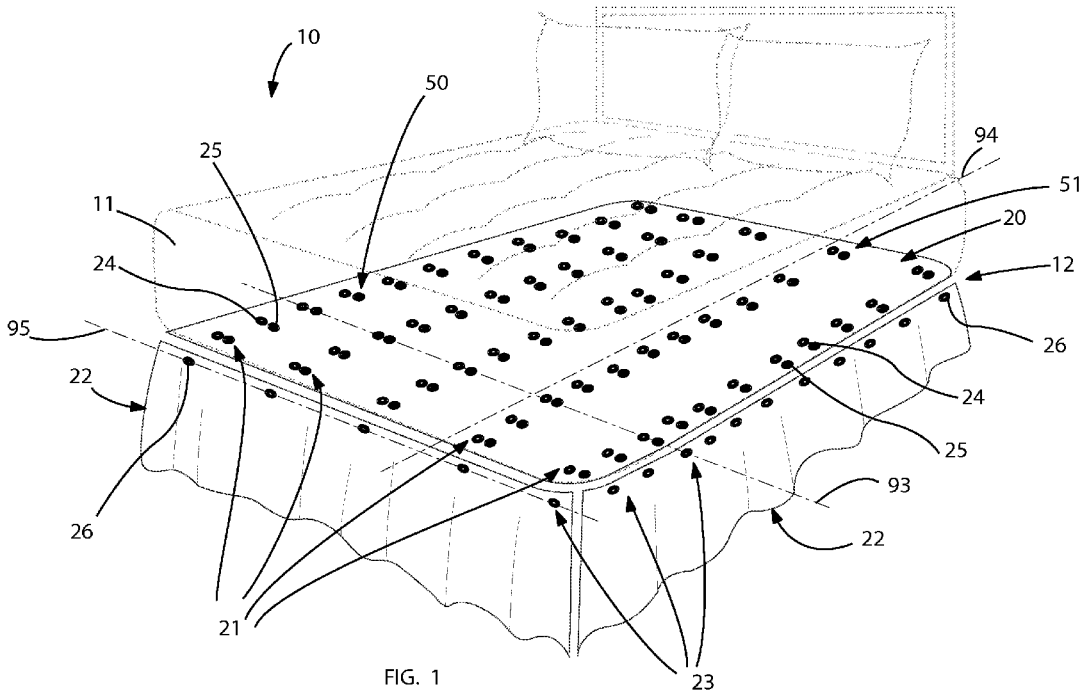
FIG. 1 is a perspective view showing a removable bed ruffle assembly, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of assembly and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

Figure 2:
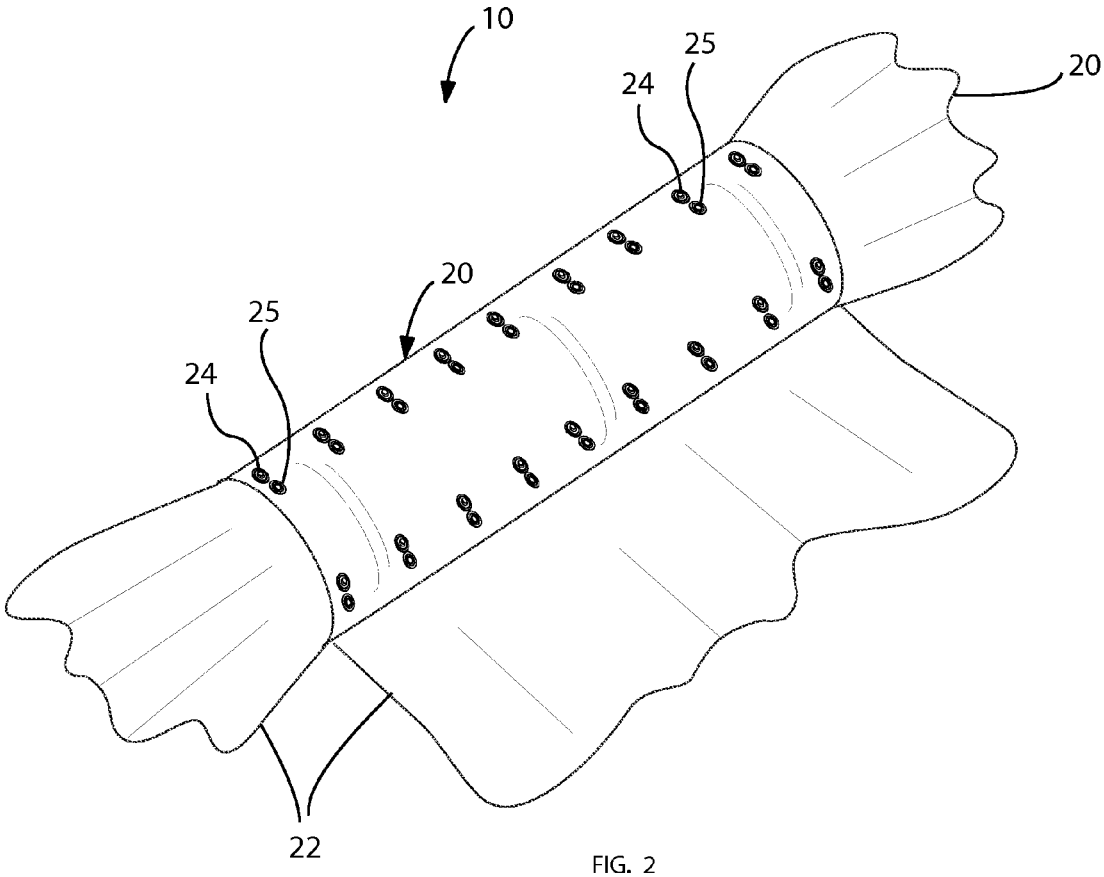
FIG. 2 is a perspective view showing the bed ruffles wrapped/snapped about the bed platform for transport.
Figure 2A:
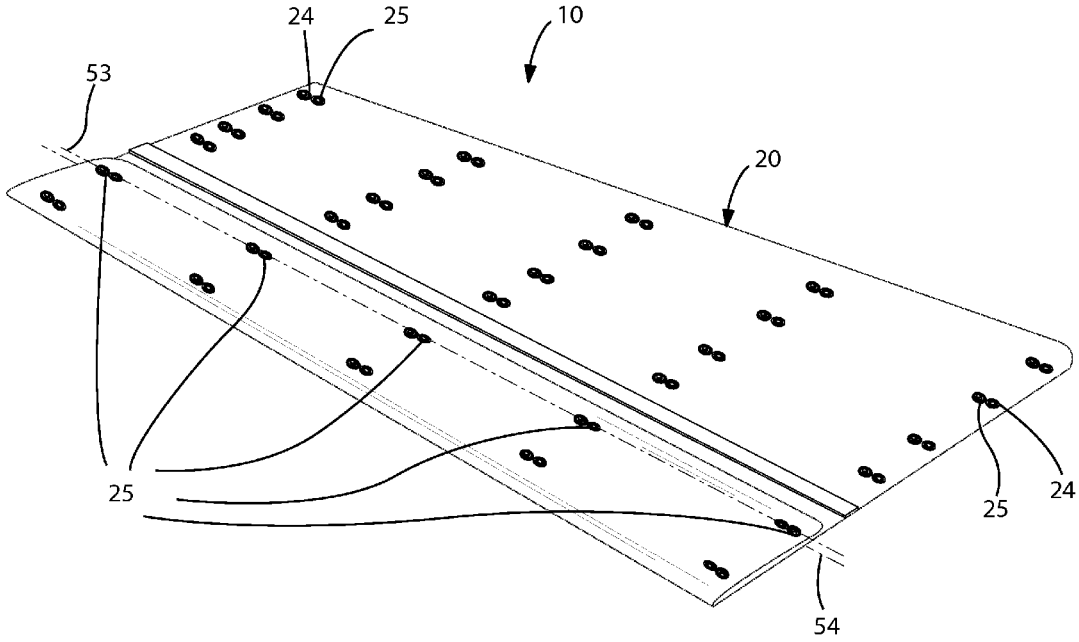
FIG. 2*a* is a perspective view of the bed platform folded/snapped along a longitudinal length thereof.
Figure 2B:
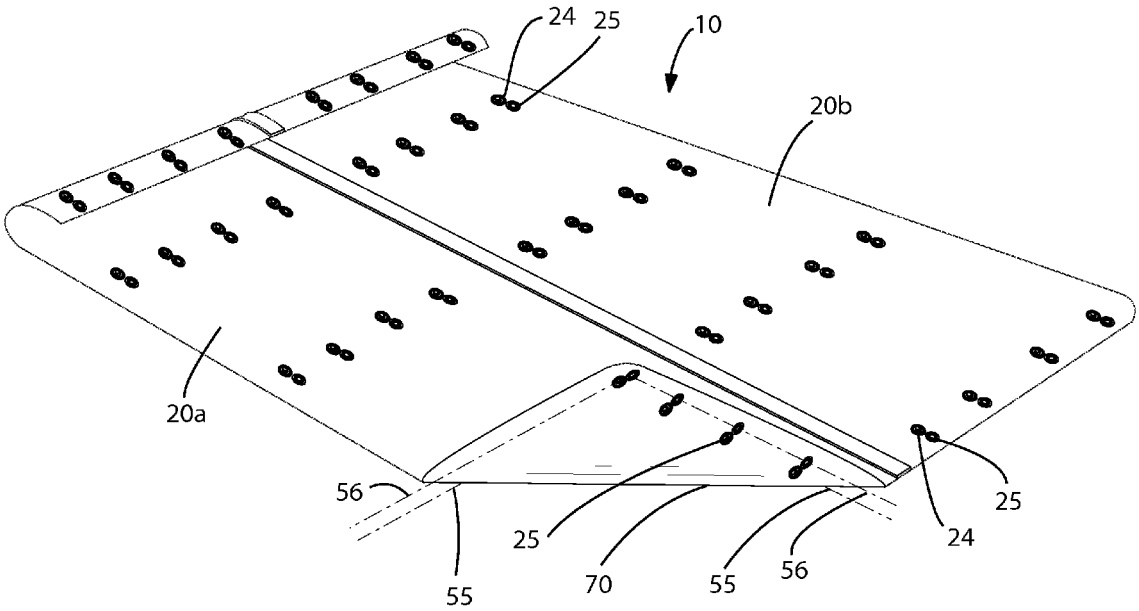
FIG. 2*b* is a perspective view of the bed platform folded/snapped at a corner thereof for diverting the bed ruffle between the top mattress and box-spring base when a night stand is abutted directly against the bed.
Figure 2C:
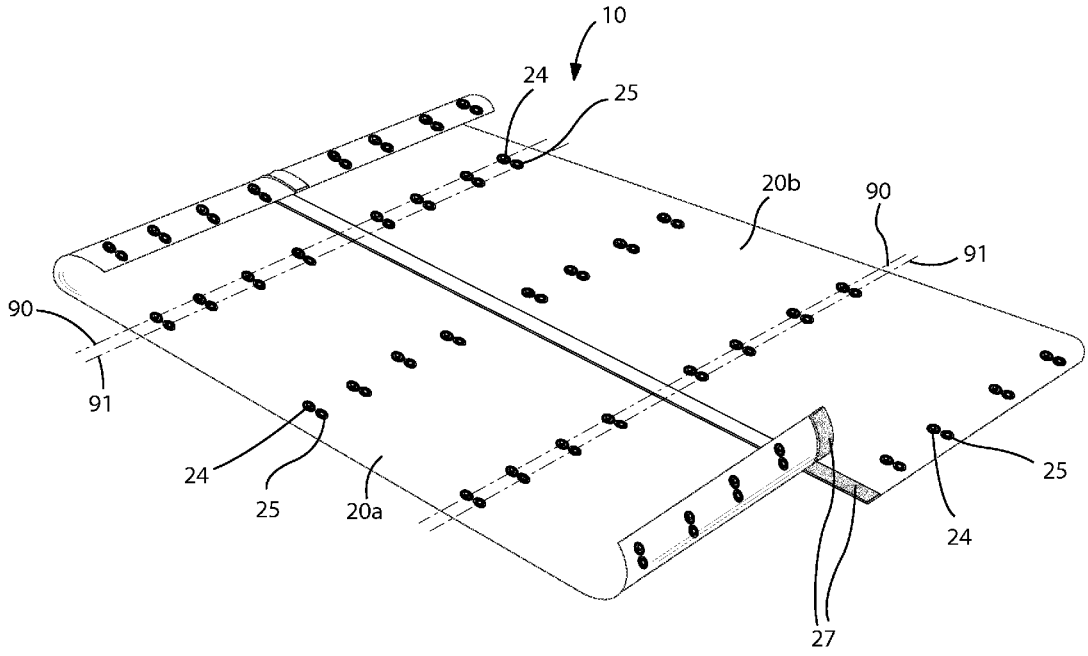
FIG. 2*c* is a perspective view of the bed platform showing the separable halves connected via a non-limiting fastener such as a hook and loop fastener.

The assembly of this invention is referred to generally in FIGS. 1-2*c* by the reference numeral 10 and is intended to provide a removable bed ruffle assembly. It should be understood that the removable bed ruffle assembly 10 may be used to quickly customize a bedding set without having to remove a top mattress from an associated box-spring base.

Referring to the FIGS. 1-2*c* in general, the interchangeable bed ruffle assembly 10 may include a bed platform 20 intercalated between the top mattress 11 and the box-spring base 12 of a bed, respectively. The bed platform 20 preferably has a plurality of first fasteners 21 attached to a top surface and juxtaposed along a perimeter and across an entire width of the bed platform 20 respectively. For example, such first fasteners 21 may be arranged in plurality of rows and columns. The rows and columns may be equidistantly spaced apart to define a uniform grid pattern spanning along the top surface of the bed platform 20. Such a grid pattern is advantageous for permitting the user to uniformly modify a length and/or width of the bed platform 20 by aligning the first fasteners 21 together.

Referring to FIG. 1, a bed ruffle 22 may be removably attached to the bed platform 20 and be capable of being seated about an outer perimeter of the top mattress 11 and the box-spring base 12. The bed ruffle 22 preferably has a plurality of second fasteners 23 attached to its inner surface. Such second fasteners 23 may be removably connected to selected ones of the first fasteners 21 respectively such that the bed ruffle 22 hangs downwardly from the perimeter of the bed platform 20. In this way, the bed ruffle 22 is freely disconnected from the bed platform 20 while the bed platform 20 remains at a stationary position. Such an arrangement provides the unexpected and unpredictable advantage of easily removing and attaching the bed ruffle 22 to the bed platform 20 without having to remove the top mattress 11 from the box-spring base 12 of the bed.

Referring again to FIG. 1, the first fasteners 21 may include primary male and primary female fasteners 24, 25 configured along a plurality of primary male and primary female linear paths 90, 91, respectively defined along the top surface of the bed platform 20. A first group 50 of each primary male and primary female fasteners 24, 25 may be oriented parallel to an x-axis 93 and a second group 51 of the primary male and primary female fasteners 24, 25 may be oriented parallel to a y-axis 94. Such an arrangement of first fastener groups 50, 51 provides the unexpected and unpredictable advantage of enabling the apparatus 10 to be configured according to the size of the bed in a one-size-fits-all construction. This permits the user to quickly align the outer circumferential edges of the bed platform 20 with the outer perimeter of the box-spring base 12 by folding and attached corresponding ones of the first fasteners 21 together.

As perhaps best shown in FIGS. 2*a*-2*c*, a bottom surface of the bed platform 20 further includes a plurality of the first fasteners 21 that become exposed and mated with the second fasteners 23 of the bed ruffle 22. Such a structural arrangement provides the unexpected advantage of quickly adjusting a height of the bed ruffle 22 by folding or unfolding the outer circumferential edges of bed platform 20 when used with various sized beds.

As perhaps best shown in FIG. 1, the second fasteners 23 may include auxiliary female fasteners 26 configured along an auxiliary female linear path 95 defined along a top edge of the bed ruffle 22. One group of the auxiliary female fasteners 26 may be oriented parallel to the x-axis 93 and located subjacent to a majority of the primary male and primary female fasteners 24, 25, respectively, when the bed ruffle 22 is attached to the bed platform 20. Another group of the auxiliary female fasteners 26 may be oriented parallel to the y-axis 94. Such an arrangement provides the unexpected and unpredictable advantage of attaching the auxiliary female fasteners 26 of the bed ruffle 22 to the primary male fastener 24 of the bed platform 20 without having to remove the bed platform 20 from the box-spring base 12.

As a non-limiting example, the bed ruffle 22 may include multiple individual segments that are independently detachable from the bed platform 20. Thus, each individual segment of bed ruffle 22 may be replaced without detaching all three segments of the bed ruffle 22. The bed ruffle 22 may be removed for washing and be replaced with a matching bedding set without having to remove the bed platform 20 anchored below the top mattress 11.

Referring to FIG. 2*a* in detail, a first linear array 53 of the first group 50 of primary female fasteners 25 may be registered parallel to an entire longitudinal edge of the bed platform 20 and detachably connected to a first linear array 54 of the first group 50 of primary male fasteners 24 such that the entire longitudinal edge of the bed platform 20 folds over an entire longitudinal length of the top surface and thereby uniformly reduces a lateral width of the bed platform 20. Such an arrangement provides the unexpected and unpredictable advantage of selectively adjusting a width of the bed platform 20 with the linear arrays 53, 54 positioned to correspond with the various bed sizes as mentioned hereinabove. This structural arrangement of first fasteners 21 alleviates the need to tuck or cram loose bed platform edges between the top mattress 11 and box-spring base 12.

Referring to FIG. 2*b* in detail, a second array 55 of the first group 50 of primary female fasteners 25 may be located along a corner of the bed platform 20 and thereby detachably connected to a second array 56 of the first group 50 of primary male fasteners 24 such that the corner of the bed platform 20 folds over a portion of the top surface and thereby creating a linear edge 70 diagonally extending from the longitudinal edge of the bed platform 20 to a latitudinal edge of the bed platform 20. Such an arrangement provides the unexpected and unpredictable advantage of folding the corner edges of the bed platform 20 and diverting the bed ruffle 22 along arrays 55, 56. The ability to fold the bed platform 20 at its corners and lock the male and female primary fastener arrays 55, 56 together permits leading edges of the bed ruffle 22 to be freely adjusted in alternate positions without having to position corresponding first and second fasteners 21, 23 along an exterior corner of the box-spring base 12. This structural configuration permits a user to abut a night stand directly against the bed while the bed ruffle 22 remains uniformly fastened and tucked between the box-spring base 12 and top mattress 11, which prevents the night stand from tugging on the bed ruffle 22.

Referring to FIG. 2*c* in detail, the bed platform 20 may include first and second halves 20*a*, 20*b* each preferably having a medial longitudinal edge and a third fastener 27 linearly extending along the medial edges of the first and second halves 20*a*, 20*b*, respectively. In this way, the first and second halves 20*a*, 20*b* are removably coupled to each other via the third fastener 27 when the medial edges are arranged in an overlapping pattern. As a non-limiting example, the third fastener 27 may be a hook and loop fastener used for removably attaching flexible and soft fabric platform materials. Such an arrangement provides the unexpected and unpredictable advantage of permitting the user to more easily pull out the bed platform 22 from between the box-spring base 12 and top mattress 11 without having to entirely remove the heavy top mattress 11 from the box-spring base 12.

The present disclosure may further include a method of utilizing an interchangeable bed ruffle assembly 10 for assisting a user to quickly customize a bedding set without having to remove a top mattress 11 from an associated box-spring base 12. Such a method may include the chronological steps of: providing a bed platform 20 preferably having a plurality of first fasteners 21 attached to a top surface thereof wherein the first fasteners 21 may be juxtaposed along a perimeter of the bed platform 20 and across an entire width of the bed platform 20; providing a bed ruffle 22 preferably having a plurality of second fasteners 23 attached to an inner surface thereof; intercalating the bed platform 20 between the top mattress 11 and the box-spring base 12 respectively; removably attaching the bed ruffle 22 to the bed platform 20 by removably connecting the second fasteners 23 to selected ones of the first fasteners 21 respectively; downwardly hanging the bed ruffle 22 from the perimeter of the bed platform 20 such that the bed platform 20 becomes seated about an outer perimeter of the top mattress 11 and the box-spring base 12 respectively; and customizing the bed ruffle assembly 10 by freely disconnecting the bed ruffle 22 from the bed platform 20 while the bed platform 20 remains at a stationary position.

In a non-limiting exemplary embodiment, the interchangeable bed ruffle assembly 10 may include a rectangular shaped bed platform 20 and a removable ruffle 22. The bed platform 20 may include at least a plurality of fasteners 21 equidistantly spaced and further arranged to correspond to the outer edge portions of various sizes of beds such as "king", "queen", "full" and "twin", for example. The removable ruffle 22 may include at least a plurality of fasteners 23 equidistantly spaced along an upper edge portion whereby fasteners 23 may detachably engage fasteners 21 on the bed platform 20, respectively. Of course a variety of conventional fasteners may be employed without departing from the true scope of the present invention. The assembly 10 may be manufactured in a variety of decorative designs and colors to match the various bed ruffles, bed cover and blanket designs. Notably, the bed ruffle 22 may be interchanged without having to lift the heavy mattress 11 from the box-spring base 12.

As noted above, the primary male and female fasteners 24, 25 may include zippers, buttons, snaps, hooks, Velcro and/or other suitable fasteners well know in the industry, to hold the removable ruffle 22 to the bed platform 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. An interchangeable bed ruffle assembly for assisting a user to quickly customize a bedding set without having to remove a top mattress from an associated box-spring base, said interchangeable bed ruffle assembly comprising:

a bed platform capable of being intercalated between said top mattress and said box-spring base respectively, said bed platform having a plurality of first fasteners attached to a top surface thereof, said first fasteners being juxtaposed along a perimeter of said bed platform and across an entire width of said bed platform; and a bed ruffle removably attached to said bed platform, said bed platform capable of being seated about an outer perimeter of said top mattress and said box-spring base respectively, said bed ruffle having a plurality of second fasteners attached to an inner surface thereof, said second fasteners being removably connected to selected ones of said first fasteners respectively such that said bed ruffle hangs downwardly from said perimeter of said bed platform;

wherein said bed ruffle is freely disconnected from said bed platform while said bed platform remains at a stationary position;

wherein said bed platform comprises:

first and second halves each having a medial longitudinal edge; and a third fastener linearly extending along said medial edges of said first and second halves respectively;

wherein said first and second halves are removably coupled to each other via said third fastener when said medial edges are arranged in an overlapping pattern.

2. The interchangeable bed ruffle assembly of claim 1, wherein said first fasteners comprise:

primary male and primary female fasteners configured along a plurality of primary male and primary female linear paths respectively defined along said top surface of said bed platform, a first group of each of said primary male and primary female fasteners being oriented parallel to an x-axis and a second group of said primary male and primary female fasteners being oriented parallel to a y-axis.

3. The interchangeable bed ruffle assembly of claim 2, wherein said second fasteners comprise: auxiliary female fasteners configured along an auxiliary female linear path defined along a top edge of said bed ruffle, said auxiliary female fasteners being oriented parallel to said x-axis and located subjacent to a majority of said primary male and primary female fasteners respectively when said bed ruffle is attached to said bed platform.

4. The interchangeable bed ruffle assembly of claim 2, wherein a first linear array of said first group of primary female fasteners are registered parallel to an entire longitudinal edge of said bed platform and detachably connected to a first linear array of said first group of primary male fasteners such that said entire longitudinal edge of said bed platform folds over an entire longitudinal length of said top surface and thereby uniformly reduces a lateral width of said bed platform.

5. The interchangeable bed ruffle assembly of claim 2, wherein a second array of said first group of primary female fasteners are located along a corner of said bed platform and thereby detachably connected to a second array of said first group of primary male fasteners such that said corner of said bed platform folds over a portion of said top surface and thereby creates a linear edge diagonally extending from said longitudinal edge of said bed platform to a latitudinal edge of said bed platform.

6. An interchangeable bed ruffle assembly for assisting a user to quickly customize a bedding set without having to remove a top mattress from an associated box-spring base, said interchangeable bed ruffle assembly comprising:

a bed platform capable of being intercalated between said top mattress and said box-spring base respectively, said bed platform having a plurality of first fasteners attached to a top surface thereof, said first fasteners being juxtaposed along a perimeter of said bed platform and across an entire width of said bed platform; and a bed ruffle removably attached to said bed platform, said bed platform capable of being seated about an outer perimeter of said top mattress and said box-spring base respectively, said bed ruffle having a plurality of second fasteners attached to an inner surface thereof, said second fasteners being removably connected to selected ones of said first fasteners respectively such that said bed ruffle hangs downwardly from said perimeter of said bed platform;

wherein said bed ruffle is freely disconnected from said bed platform while said bed platform remains at a stationary position;

wherein said first fasteners comprise:

primary male and primary female fasteners configured along a plurality of primary male and primary female linear paths respectively defined along said top surface of said bed platform, a first group of each of said primary male and primary female fasteners being oriented parallel to an x-axis and a second group of said primary male and primary female fasteners being oriented parallel to a y-axis.

7. The interchangeable bed ruffle assembly of claim 6, wherein said bed platform comprises:

first and second halves each having a medial longitudinal edge; and a third fastener linearly extending along said medial edges of said first and second halves respectively;

wherein said first and second halves are removably coupled to each other via said third fastener when said medial edges are arranged in an overlapping pattern.

8. The interchangeable bed ruffle assembly of claim 6, wherein a second array of said first group of primary female fasteners are located along a corner of said bed platform and thereby detachably connected to a second array of said first group of primary male fasteners such that said corner of said bed platform folds over a portion of said top surface and thereby creates a linear edge diagonally extending from said longitudinal edge of said bed platform to a latitudinal edge of said bed platform.

9. The interchangeable bed ruffle assembly of claim 6, wherein said second fasteners comprise: auxiliary female fasteners configured along an auxiliary female linear path defined along a top edge of said bed ruffle, said auxiliary female fasteners being oriented parallel to said x-axis and located subjacent to a majority of said primary male and primary female fasteners respectively when said bed ruffle is attached to said bed platform.

10. The interchangeable bed ruffle assembly of claim 6, wherein a first linear array of said first group of primary female fasteners are registered parallel to an entire longitudinal edge of said bed platform and detachably connected to a first linear array of said first group of primary male fasteners such that said entire longitudinal edge of said bed platform folds over an entire longitudinal length of said top surface and thereby uniformly reduces a lateral width of said bed platform.

* * * * *